US006455795B1

(12) United States Patent
Murakami et al.

(10) Patent No.: US 6,455,795 B1
(45) Date of Patent: Sep. 24, 2002

(54) KEY SWITCH IMPROVED IN FEEL OF ACTUATION AND RETURN SPEED DURING OPERATION BY FINGER

(75) Inventors: Takahiro Murakami; Hideki Ito, both of Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/407,398

(22) Filed: Sep. 29, 1999

(30) Foreign Application Priority Data

Sep. 30, 1998 (JP) ..... 10-294556

(51) Int. Cl.[7] ..... H01H 3/04; H01H 3/20
(52) U.S. Cl. ..... 200/345; 200/5 A; 200/517
(58) Field of Search ..... 200/5 A, 517, 200/341, 345, 520, 342, 329, 513, 512, 344

(56) References Cited

U.S. PATENT DOCUMENTS 5,283,408 A * 2/1994 Chen ..... 200/345
5,406,277 A 4/1995 Lee
5,496,982 A * 3/1996 Tsai ..... 200/345
5,516,996 A * 5/1996 Shin ..... 200/345
5,718,327 A * 2/1998 Wu ..... 200/344
5,762,423 A * 6/1998 Mori et al. ..... 384/279
5,938,009 A * 8/1999 Huang ..... 200/517
6,184,481 B1 * 2/2001 Chen ..... 500/5 A

* cited by examiner

*Primary Examiner*—Elvin Enad
*Assistant Examiner*—Kyong S. Lee
(74) *Attorney, Agent, or Firm*—Brinks Hofer Gilson & Lione

(57) ABSTRACT

Disclosed is a key switch in which a stem extending from a key top is slidably inserted into a seat formed on a housing; and longitudinal grooves extending in the direction of the axis X of reciprocating movement of the stem are formed in the circumferential surface of the stem which is in contact with the inner surface of the seat.

9 Claims, 2 Drawing Sheets

KEY SWITCH IMPROVED IN FEEL OF ACTUATION AND RETURN SPEED DURING OPERATION BY FINGER

BACKGROUND OF THE INVENTION

1. Field of the Invention

The present invention relates to a key switch improved in the feel of actuation and return speed during switch operation by a finger.

2. Description of Related Art

In a key switch arranged on a keyboard as shown for instance in FIG. 3, a key top 101 has a stem 102 extending downwardly from the key top; the stem 102 is slidably inserted in a seat 104 formed on a housing 103 of the keyboard; the lower end of the stem 102 is connected to the top of a rubber spring 105 which is of an inverted cup shape; a pressing portion 106 is formed downwardly from the center of the top of the rubber spring 105, so that when the key top 101 is pushed with a finger, the pressing portion 106 presses a membrane switch 107 disposed below, thereby closing the switch. When the finger is removed from the key top 101 to release the pressure from the key switch 101, the key top 101 is instantly moved back to the original non-pushed position by the reactive force of the rubber spring 105, thus simultaneously opening the switch.

The key top 101, however, is not necessarily pushed from right above on the axis of the stem 102. In some case, it happens that the key top 101 is pushed on the edge with a force applied obliquely to the stem 102. In this case, a force to push the key acts in the horizontal direction on the upper and lower ends of the seat 104 of the housing. Therefore not only does the stem 102 vibrate during vertical movement, giving a feel of hitch to the finger pushing the key top, but the pressing portion 106 of a rubber spring fails to reach the membrane switch 107, with the result that the switch will not be closed even though the key top 101 is depressed. Furthermore, when the finger is removed from the key top 101, the reactive force of the rubber spring 105 will not necessarily be applied uniformly to the lower end of the stem 102. The stem 102, therefore, will fail to smoothly rise and return, and in some cases, will fail to move fully back because of friction between the stem 102 and the seat 104.

The stem 102 and the seat 104 are in most cases made of a material similar to, for instance, ABS resin. In this case, the stem 102 and the seat 104 are likely to stick to each other because of their affinity, resulting in unsmooth sliding.

SUMMARY OF THE INVENTION

To solve the above-described problems, therefore, the present invention has an object to provide a key switch which has been improved in the feel of actuation and return speed of the switch when the key top is pressed with a finger.

That is, the present invention provides a key switch, in which when a reciprocally movable key top is pushed, a stem extending from the key top moves in one direction along the axis of reciprocating motion to actuate a switching member; and when the pressure is removed from the key top, the key top will return to the original position. The stem is slidably inserted in the seat formed on the housing of the key switch, and at least one longitudinal groove is formed extending in the aforesaid direction of the axis in the circumferential surface of the stem which is in contact with the inner surface of the seat.

Since there is formed at least one longitudinal groove axially extending in the circumferential surface of the stem which is in contact with the inner surface of the seat, any stress will be dispersed by the longitudinal groove if applied obliquely when the stem axially strokes in the seat, thereby preventing stem vibration.

Key switches are preferably mounted on the keyboard. The key switches have various shapes and dimensions, are all arranged on the entire upper surface of the keyboard, and are pressed by fingers. In this case, because quick and constant finger touch (feel of key operation) is required not withstanding varied switch pushing modes, it is especially preferable to adopt the key switch of the present invention.

In the stem, four longitudinal grooves are formed symmetrically in relation to the axis. It is desirable that the four longitudinal grooves be arranged so that the circumferential sliding surfaces of the stem formed among the longitudinal grooves will be positioned in lateral and longitudinal directions of the keyboard.

Generally, in a keyboard, if a pressure is applied obliquely to the stem when the key top is pushed by a finger, the pressure applied obliquely will act in most cases in the longitudinal and/or lateral direction of the keyboard. Therefore, the stem, if provided with the sliding surface formed longitudinally and laterally, will become less liable to wear and deformation, resulting in improved durability of the keyboard.

It is preferable that the sliding surface of the stem be coated with a lubricant inclusive of fine particles of fluoroplastics or silicone resin. The stem and the seat are in most cases formed of a homogeneous material; in this case, therefore, the key top fails to make smooth up-and-down strokes due to their mutual adsorptive activity. The lubricant including the fluoroplastics particles thus applied to the sliding portions of the stem and the seat serves to lessen friction and to remove the adsorptive power of the parts.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

A preferred embodiment of a key switch according to the present invention will hereinafter be explained with reference to the accompanying drawings.

Figure 1A:
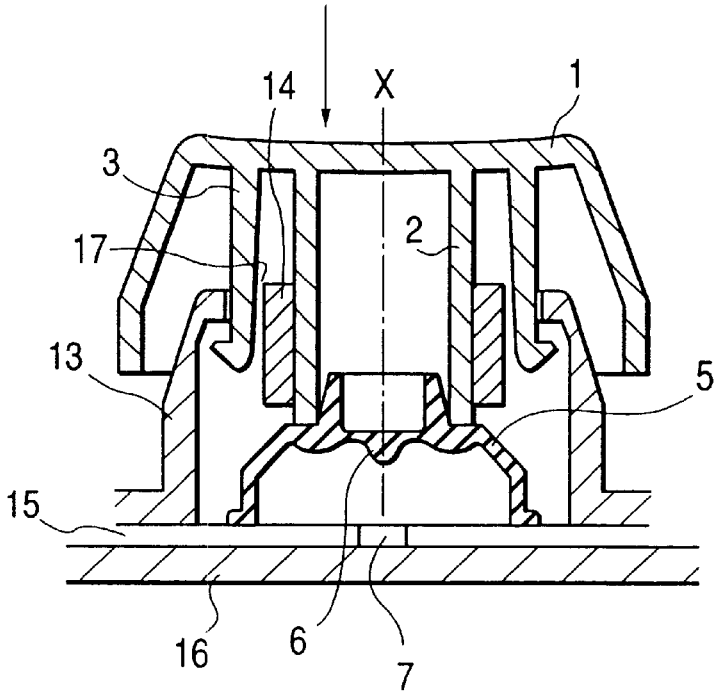
FIGS. 1A and 1B are longitudinal sectional views showing a key switch being actuated in one embodiment of the present invention.
Figure 1B:
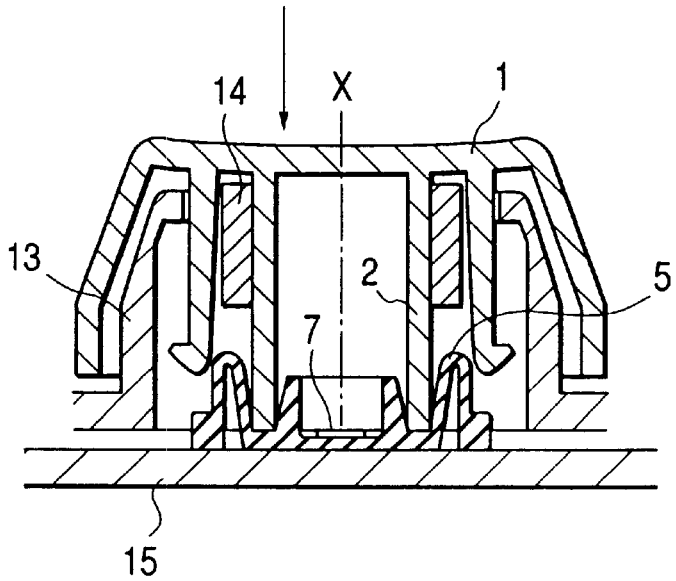
Figure 2:
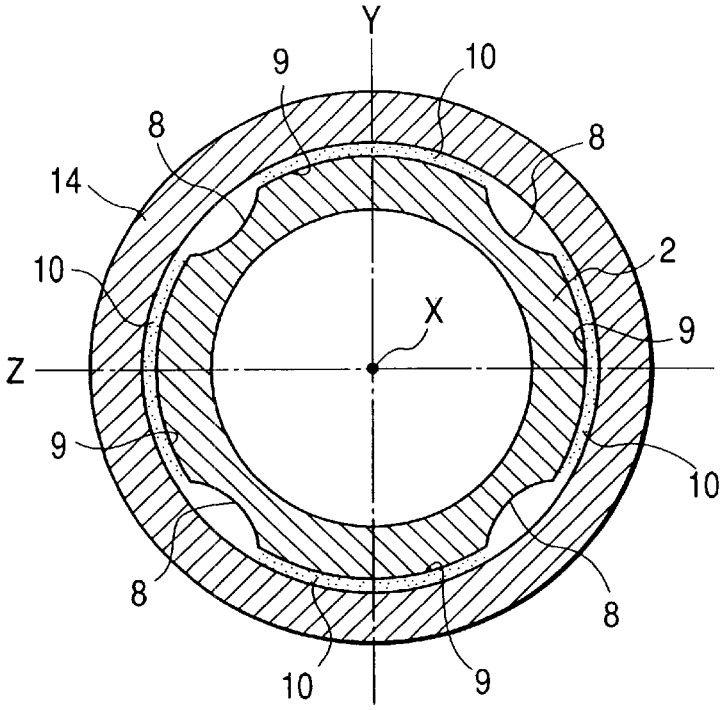
FIG. 2 is a cross sectional view of a stem and a seat of the embodiment of the present invention.
Figure 3:
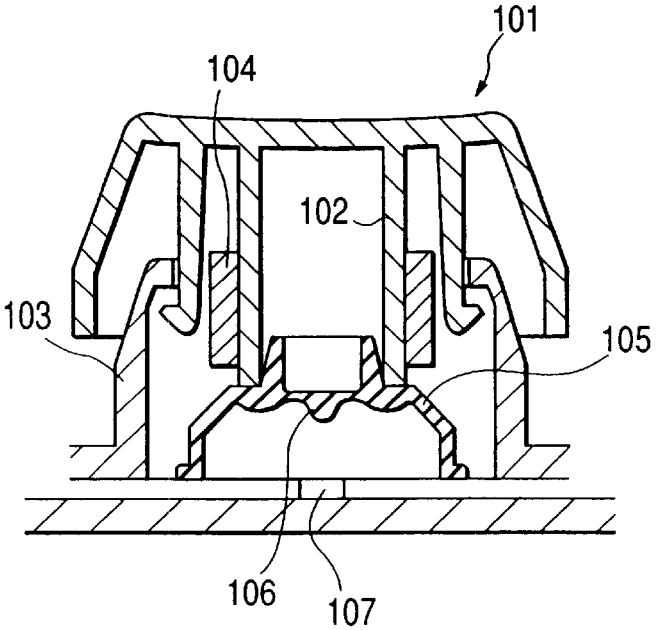
FIG. 3 PRIOR ART
FIG. 3 is a longitudinal sectional view showing one example of a conventional key switch.

FIGS. 1A and 1B are longitudinal sectional views showing one embodiment of the key switch of the present invention mounted on a keyboard of a personal computer, in which FIG. 1A shows the key switch not depressed, and FIG. 1B shows the key switch in a depressed state. FIG. 2 is a cross sectional view of the stem and the seat sectioned perpendicularly with respect to the axis X.

In FIGS. 1A and 1B, the key switch has a key top 1 which can stroke up and down, a stem 2 extended downwardly from the key top 1, a rubber spring 5 connected to the lower end of the stem 2, and a membrane switch 7 as a switch member disposed beneath the rubber spring 5. The stem 2 stated above is formed in a cylindrical shape and slidably inserted in a seat 14 formed on the housing 13 of the keyboard.

The stem 2 is provided with four longitudinal grooves 8 extending in the direction of the axis X, in the circumferential surface which is in contact with the inner surface of the seat 14 as shown in FIG. 2. The four longitudinal grooves 8 formed symmetrically with respect to the axis X are so arranged as to be 45 degrees from the longitudinal direction Y and the lateral direction Z so that the sliding portions 9 of the stem formed among these grooves will be oriented in the longitudinal direction Y and the lateral direction Z of the keyboard. The sliding portions 9 of the stem 2 are coated with a lubricant 10 containing fine particles of fluoroplastics.

The key switch has a pawl portion 3 on the underside of the key top 1, extending downwardly from the outside of the stem 2. The pawl portion 3 is engaged in a pawl catch hole 17 formed in the housing 13, so that the key top 1 will never come off if pulled.

The rubber spring 5 is a rubber molding of an inverted cup shape and is mounted on a metal base plate 16 through a printed circuit board 15 of the keyboard. The rubber spring 5 has a cylindrical projection extending from the top portion thereof upwardly to fit in the lower end portion of the stem 2. Also on the underside of the rubber spring 5, a pushing portion 6 is formed at the center of the top portion to push the membrane switch 7. The membrane switch 7 is comprised of a printed circuit formed on the printed circuit board 15 located immediately below the pushing portion 6.

According to the key switch of the present invention when the key top 1 is pushed on the upper surface by a finger, the stem 2 slides in the seat 14, moving downwardly until the lower end pushes down the top of the rubber spring 5. Thus the pushing portion 6 presses the membrane switch 7 to activate the key switch. When the finger is removed from the key top 1, the key top 1 is moved back to the original position by the reactive force of the rubber spring 5, thereby turning off the switch.

Since the longitudinal grooves 8 are formed in the stem 2, the stem 2 can smoothly and quickly stroke without vibration and hitch in the direction of the axis X if an oblique force is applied to the key top 1. Furthermore, since the four longitudinal grooves 8 are formed in the stem 2, and the sliding portions 9 between these longitudinal grooves 8 are positioned in the longitudinal direction Y and the lateral direction Z, there is maintained a substantial contact surface area between the stem 2 and the seat 14 in both longitudinal and lateral directions of the keyboard, thereby preventing wear of the sliding surfaces and the occurrence of stem vibration.

As previously stated, since the sliding portions 9 of the stem are coated with the lubricant 10, which includes fine particles of fluoroplastics, wear of the stem 2 and the seat 14 is reduced. In addition, smooth up-and-down stroking of the key top is ensured despite the absorptivity of the stem 2 and the seat 14 if produced of a homogeneous material such as an ABS resin. The lubricant 10, having a damping effect, acts also to control the feel of push and return speed of the key top, eliminating an unpleasant bounce likely to occur at the end of a return stroke; that is, a good feel of key operation will be achieved.

Basically, the salient feature of the key switch of the present invention is the formation of longitudinal grooves in the circumferential surface of the stem which is in contact with the inner surface of the seat. It therefore should be noticed that various modifications other than the present embodiment are possible. For instance, the key switches of the present invention may be those for use in other equipment than the keyboard. Also, the key top may be of a square, circular, or L-shape. The sectional shape of the stem may be of a circular, oval, or oblong shape. Furthermore, other elastic material or spring material may be used in place of the rubber spring; and the switch member is not limited to a membrane switch.

The aforesaid lubricant is preferred to be a grease-like lubricant containing fine particles of fluoroplastics or silicone resin. And its medium is preferred to be a fluorine oil or silicone oil. The lubricant may contain a volatile solvent for convenience of coating.

In the key switch of the present invention the longitudinal grooves are formed in the circumferential surface of the stem that is in contact with the inner surface of the seat of the housing, extending in the direction of axis of reciprocating motion. Therefore the problem of vibration likely to occur during a push/return stroke can be overcome, resulting in improved feel of actuation and return speed of the switch by the finger.

Furthermore, if the four longitudinal grooves formed as previously stated are so arranged that the sliding portions formed among the longitudinal grooves will be oriented in the longitudinal and lateral directions of the keyboard, wear of the stem can be reduced by the longitudinal grooves thus formed to thereby prolong the life of the keyboard.

A lubricant containing fine particles of fluoroplastics or silicone resin, if applied to the sliding surfaces of the stem, can restrain wear of the stem, giving the user a good feel of key operation.

What is claimed is:

1. A key switch comprising:

a key top that is reciprocally movable along an axis; and a stem extended from said key top, said stem moving in one direction along the axis of reciprocating movement to thereby actuate a switch member when said key top is pressed by a finger, and returning to an original position when the finger is removed from said key top;

wherein said stem is slidably inserted in a seat formed in a housing of said key switch, said stem having an outer surface disposed adjacently to an inner surface of said seat, and wherein a plurality of spaced apart longitudinal grooves are formed extending in the direction of said axis, said longitudinal grooves being formed in the outer surface of said stem so as to form sliding portions there between, said sliding portions having a surface area that is greater than a surface area of the longitudinal grooves, said sliding portions being in sliding contact with the inner surface of said seat.

2. A key switch according to claim 1, wherein said key switch is mounted on a keyboard, said keyboard having longitudinal and lateral directions along which a plurality of key switches are mounted.

3. A key switch according to claim 2, wherein said stem has a circular cross-section, and said longitudinal grooves are formed in four positions symmetrically spaced about said axis, said four longitudinal grooves being arranged so that the sliding portions formed on the outer surface of said stem between said longitudinal grooves are positioned along the longitudinal and lateral directions of said keyboard.

4. A key switch according to claim 1, wherein said sliding portions of said stem are coated with a lubricant containing fine particles of fluoroplastics or silicone resin.

5. A key switch according to claim 1, further comprising a plurality of pawls extended from said key top, said pawls being configured to engage catch holes formed in the housing of said key switch.

6. A key switch according to claim 6, wherein said pawls are disposed outwardly from said stem, and wherein said catch holes are disposed outwardly from said seat.

7. A key switch comprising:

a housing having a seat and a plurality of catch holes;

a switch member disposed in said housing;

a key top that is reciprocally movable along an operational axis of said key switch between an original position and a depressed position, said key top being movable from the original position to the depressed position when pressed by a finger to thereby actuate said switch member, and movable from the depressed position to the original position when the finger is removed from said key top;

a stem extending from a lower side of said key top along the operational axis of said key top, said stem having a generally circular cross-section comprising a plurality of convex sliding portions and a plurality of concave grooves longitudinally disposed along the operational axis of said key top, each of the sliding portions being disposed between an adjacent pair-of grooves and having an outer surface configured to slidably engage an inner surface of said seat; and a plurality of pawls extending from the lower side of said key top, said pawls being spaced outwardly from said stem and configured to engage the catch holes of said housing so as to prevent said key top from being disengaged from said housing, wherein the sliding portions each has a width that is greater than a width of the grooves, and wherein said sliding portions are each are coated with a lubricant containing fine particles of one of fluoroplastics and silicone resin.

8. A key switch according to claim 7, wherein the stem comprises four sliding portions and four grooves alternately spaced at equal intervals about the operational axis of the key top.

9. A keyboard having a plurality of key switches according to claim 8 mounted thereon, said plurality of key switches being arranged on said keyboard in parallel rows, each of the rows being disposed along a row axis, wherein the grooves of each of said key switches are disposed at 45° angles relative to the row axis.

* * * * *

UNITED STATES PATENT AND TRADEMARK OFFICE

CERTIFICATE OF CORRECTION

PATENT NO. : 6,455,795 B1
DATED : September 24, 2002
INVENTOR(S) : Takahiro Murakami et al.

It is certified that error appears in the above-identified patent and that said Letters Patent is hereby corrected as shown below:

Column 5,
Line 5, delete "claim 6," and substitute -- claim 5, --
Line 26, delete "pair-of" and substitute -- pair of --

Column 6,
Line 11, delete "are each are" and substitute -- are each --

Signed and Sealed this

Eighth Day of April, 2003

JAMES E. ROGAN
*Director of the United States Patent and Trademark Office*